US007359288B2

(12) United States Patent
Auer

(10) Patent No.: US 7,359,288 B2
(45) Date of Patent: Apr. 15, 2008

(54) METHOD AND APPARATUS FOR AUTOMATICALLY DISPLAYING A CORRECT TIME AND DATE WHEN INITIALLY ACTIVATING A CLOCK

(75) Inventor: Gottfried Auer, Windsbach (DE)

(73) Assignee: Emerson Radio Corp., Parsippany, NJ (US)

( * ) Notice: Subject to any disclaimer, the term of this patent is extended or adjusted under 35 U.S.C. 154(b) by 543 days.

(21) Appl. No.: 10/393,636

(22) Filed: Mar. 21, 2003

(65) Prior Publication Data

US 2004/0027921 A1 Feb. 12, 2004

Related U.S. Application Data

(63) Continuation of application No. 09/161,536, filed on Sep. 28, 1998, now Pat. No. 6,567,344.

(30) Foreign Application Priority Data

Apr. 6, 1998 (DE) ..... 298 06 161 U

(51) Int. Cl.
*G04B 19/22* (2006.01)
*G04C 19/00* (2006.01)

(52) U.S. Cl. ..... 368/21; 368/187

(58) Field of Classification Search ..... 368/21, 368/22, 28, 29, 64, 66, 69, 185–187
See application file for complete search history.

(56) References Cited

U.S. PATENT DOCUMENTS 4,015,420 A * 4/1977 Walker ..... 368/69
4,059,842 A * 11/1977 Meacham ..... 348/524
4,125,993 A * 11/1978 Emile, Jr. ..... 368/82
4,165,532 A * 8/1979 Kendall et al. ..... 700/284
4,659,231 A 4/1987 Barkouki ..... 368/15
4,695,168 A * 9/1987 Meister et al. ..... 368/31
4,701,858 A * 10/1987 Stokes et al. ..... 702/58
4,887,251 A * 12/1989 Takada ..... 368/21
4,956,826 A * 9/1990 Coyman et al. ..... 368/28
4,995,020 A 2/1991 Mitchell ..... 368/185
5,001,752 A * 3/1991 Fischer ..... 713/178
5,199,009 A * 3/1993 Svast ..... 368/240
5,301,116 A * 4/1994 Grunig ..... 705/410

(Continued)

FOREIGN PATENT DOCUMENTS

DE 29608563 U1 9/1996

(Continued)

OTHER PUBLICATIONS

"Video Camera Recorder Operating Instructions", Sony CCD-TRV14E/TRV24E, (14 pages), 1997.*

*Primary Examiner*—Vit W Miska
(74) *Attorney, Agent, or Firm*—Darby & Darby P.C.

(57) ABSTRACT

Method and apparatus for automatically displaying a correct time and date when initially activating a clock. After manufacture of the clock and before it is purchased by the user, a basic data set, including the time and geographical region data, are input to the clock via an interface. The data are stored in a memory of a microcontroller. After purchase by a user, the clock is plugged into a power grid and the correct time and date are displayed without the need to set the clock.

44 Claims, 1 Drawing Sheet

U.S. PATENT DOCUMENTS 5,365,494 A * 11/1994 Lynch ..... 368/10
5,490,077 A * 2/1996 Freytag ..... 705/405
5,490,122 A 2/1996 Kojima ..... 368/21
5,499,220 A 3/1996 Ogasawara ..... 368/21
5,555,226 A 9/1996 Lizzi ..... 368/21
5,881,023 A * 3/1999 Gu et al. ..... 368/10
5,920,824 A 7/1999 Beatty et al. ..... 455/550
5,946,672 A * 8/1999 Chrosny et al. ..... 705/410
5,999,921 A * 12/1999 Arsenault et al. ..... 705/410
6,069,848 A * 5/2000 McDonald et al. ..... 368/107

FOREIGN PATENT DOCUMENTS

EP 0 652 497 A2 10/1995

* cited by examiner

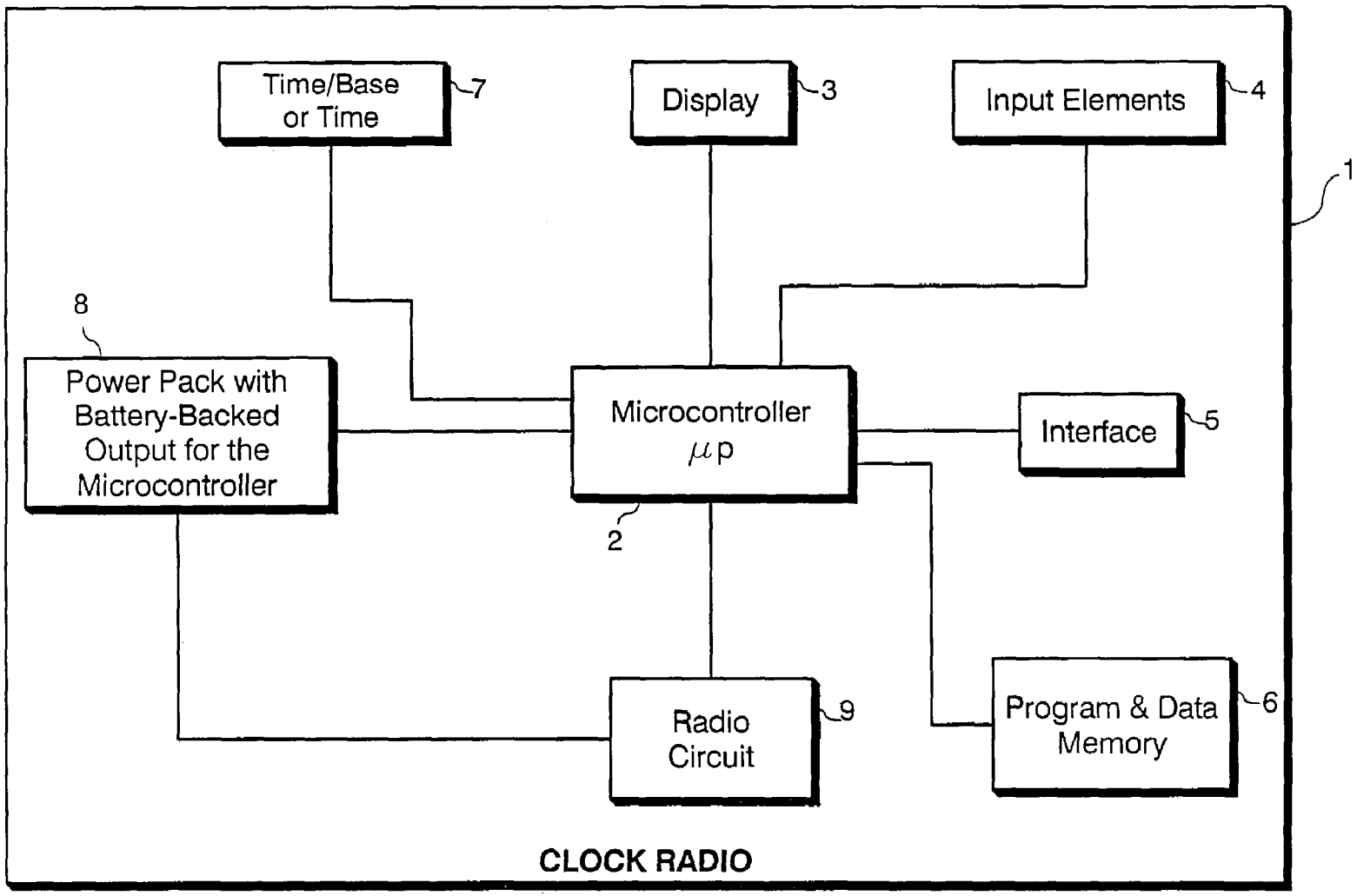
1
4
Input Elements
3
Display
7
Time/Base or Time
5
Interface
Microcontroller μp
2
6
Program & Data Memory
9
Radio Circuit
8
Power Pack with Battery-Backed Output for the Microcontroller
CLOCK RADIO

METHOD AND APPARATUS FOR AUTOMATICALLY DISPLAYING A CORRECT TIME AND DATE WHEN INITIALLY ACTIVATING A CLOCK

This is a continuation of application Ser. No. 09/161,536, filed Sep. 28, 1998 now U.S. Pat. No. 6,567,344. Each of these prior applications is hereby incorporated herein by reference, in its entirety.

BACKGROUND OF THE INVENTION

1. Field of the Invention

The invention generally relates to the field of clocks and, more particularly, to a clock or clock having a time and date display. The clock can also be made as a clock with a wake-up function or as a radio alarm.

2. Description of the Related Art

Clocks, and in particular clocks that have date and time displays, are known. Specifically, clock radios which, after being started by a buyer, set themselves automatically to the actual time are known. In some cases, such clocks set themselves to display the actual date. However, automatic time setting, as well as automatic date setting only occurs when a time data signal transmitted by radio (e.g., the DCF77 time mark signal transmitted in Germany) at the location of the clock can be received by the clock with a sufficient level of quality. The receipt of such a time mark signal is not always guaranteed.

It is therefore apparent that there is a need for a clock that sets its time independently from the reception of a time data signal that is transmitted via radio waves.

SUMMARY OF THE INVENTION

The invention is a method and apparatus for automatically displaying a correct time and date when initially activating a clock. In accordance with the invention, after the manufacture of the clock and before it is purchased by a user, the actual time is input to the clock via an electro-mechanical interface. In the preferred embodiment, the actual date or a corresponding data set are input to the clock via the electro-mechanical interface. The clock then continues to run and correctly displays the actual time. This is accomplished by using a program that is stored in memory and/or by using data necessary for correctly displaying the time that are also stored in the memory. In preferred embodiments, the clock displays time and date information.

In the clock, the data necessary for displaying the correct time, and for optionally displaying the correct date, contain data such as calendar data that is stored in the memory of the control circuit or microcontroller. In preferred embodiments, the data comprises an "eternal" calendar with leap year, date and time of reset from summer to winter time and vice versa.

In accordance with the invention, setting of the clock is performed after completion and before purchase by the user, such as while the clock is still in production or when the clock is delivered to a dealer (distributor) or individual store. As a result, the user is provided with the correct time and date display when the clock is initially plugged into a power grid (i.e., a grid-power) and powered up because the clock starts without the need to reset the time and date, etc., of the clock.

Particularly in countries that have several time zones, it is possible for the user to choose the desired time zone via an input to the control circuit or microcontroller. The display shows the current time applicable to this time zone, and optionally the current date.

BRIEF DESCRIPTION OF THE DRAWING

The foregoing and other advantages and features of the invention will become more apparent from the detailed description of the exemplary embodiments of the invention given below with reference to the accompanying drawing in which:

The sole FIGURE is a schematic block diagram of a grid-powered clock radio in accordance with the invention.

DETAILED DESCRIPTION OF THE PREFERRED EMBODIMENT

The sole FIGURE is a schematic block diagram of a clock radio in accordance with an exemplary embodiment of the invention. As shown therein, the central element of a clock radio 1 is a microcontroller 2 to which, among others, the following functional elements are assigned:

display 3;
input elements 4;
electro-mechanical interface 5;
program and data memory 6; and
time base or master clock 7.

The display 3 is a digital display, such as a Liquid Crystal Display (LCD) or Light Emitting Display (LED). In alternative embodiments, the display has clock hands for representation of the time in much the same way that a clock having a minute hand, a second hand, and a hour hand would display the time.

With further reference to the FIGURE, input elements 4 are used to set the function of the clock radio or radio alarm 1. In the preferred embodiment, input elements 4 are push buttons. The input elements 4 make it possible to set functions of the clock radio or radio alarm 1, such as the wake-up and alarm time for a user.

The time base 7 is a high precision, crystal-controlled time base that is synchronized to the main power supply frequency for the clock radio.

The microcontroller 2, and the function elements assigned to it, utilizes a voltage supply 8 that has a back-up battery. In the event that a grid or power failure occurs, the function of the microcontroller 2 and preservation of the data stored in the memory 6 are ensured.

Also included is a radio circuit 9 that possesses all the functional elements that are necessary for a radio, including a speaker. The radio circuit 9 is triggered by the microcontroller 2 so that the radio is turned on at the alarm or wake-up time, for example. To supply the circuit 9, the voltage supply or power pack 8 is used without the need to back-up the supply with the back-up battery.

One key aspect of the clock radio 1 of the present invention is that all calendar data, including an "eternal calendar", leap years, time of switching between summer/winter time and vice versa are stored in memory 6 as a basic data set (e.g., in a read-only memory or memory that has the properties or features of a ROM). By way of the electro-mechanical interface 5, when the clock radio 1 is sold, but preferably at the manufacturer or distributor or retailer, the clock radio 1 is set to the current time and date that is valid for the respective sales region. The data are read digitally via a setting means, such as a computer with a corresponding setting program, into memory 6 and stored there. Proceeding from the data set via the interface 5, and then by way of the signal generated by time base 7, the data displayed on the display 3 are updated (e.g., time, data, weekday, etc.).

In geographical areas or countries that have several time zones, the setting is performed for a certain stipulated time zone (base time zone). Using the input elements 4, a user of the clock selects his time zone by inputting the time that corresponds to the specific time zone in which he is located. From the data for the base time zone, the microcontroller 2 determines the data for the time zone selected by the user and stores them in the memory 6 as the base for further representation of the time and date on the display 3. Alternatively, it is possible to input the current data (date, time, etc.) for all time zones by way of the electro-mechanical interface 5 when initially setting the clock.

Regardless of how the clock is set, it holds that when clock radio 1 is powered up and started for the first time, display 3 shows the current time, the current date and the current day of the week, without the need to specifically set the clock. Important elements of the above described clock radio 1, especially the microcontroller 2, the memory 6 assigned to it and components of the time base 7, can be combined in one semiconductor chip.

The above invention was described using the example of a clock radio. It goes without saying that a clock or alarm clock can be made in the same manner, where the radio circuit 9 is omitted.

The invention claimed is:

1. A clock having a microcontroller, a display and a time base generator producing a time reference, comprising:

an electromechanical interface connecting a computer setting means directly to the microcontroller for uploading a basic data set comprising at least time of day data associated with a specific geographical region to the microcontroller subsequent to manufacture of the clock;

memory cooperating with the microcontroller, said memory storing the basic data set associated with a specific-geographic region; and a power supply connected to the microcontroller for powering the clock; said power supply having a battery for providing continuous power so the function of the microcontroller and the time base generator are ensured during transport of the clock; and said microcontroller using the time reference of the time base generator to update the time during transport of the clock wherein, upon connecting the power supply to power, the microcontroller causes the display of the clock to show at least the current time in the specific geographic region.

2. The clock of claim 1, wherein the memory stores calendar data for displaying the correct date and time adjustments for summer/winter time.

3. The clock of claim 1, wherein the clock is part of a clock radio.

4. The method of claim 1, wherein the geographical region is a specific time zone.

5. The clock of claim 1, further comprising:

entry elements cooperating with the microcontroller to cause a change in the current time.

6. The clock of claim 1, wherein the interface is adapted to connect to a computer.

7. A method for presetting a clock having a microcontroller, an electromechanical interface connected directly to the microcontroller, a display, a time base generator, a memory cooperating with the microcontroller, a power supply, and a back-up power source, the method comprising the steps of:

prior to distribution of the clock, but subsequent to manufacture of portions of the clock, loading into the memory via the interface from a computer setting means a basic data set comprising time of day data for a specific geographical region;

calculating the current time in the microcontroller from said time base generator and said basic data set during transport thereof to ensure that the correct time associated with the specific geographic region is maintained, while said back-up power source is connected to said microcontroller and said time base generator, and said power supply is disconnected; and connecting the power supply so as to energize the clock and display the current time in the specific geographic region.

8. The method of claim 7, further comprising the step of:

additionally setting via the interface at least one of the current date, the current day of the week and calendar data associated with the geographic region.

9. The method of claim 7, further comprising the step of:

inputting time of day data of multiple time zones via the interface.

10. The method of claim 7, wherein the basic data set further comprises calendar data.

11. The method of claim 10, wherein the calendar data further comprises eternal calendar data for switching between summer/winter time for the specific geographical region.

12. The method of claim 7, wherein the clock further includes an entry device for inputting information to the microcontroller, and wherein the method further includes the step of selecting time zones other than the specific geographic region by using the entry device.

13. The method of claim 7, wherein the clock is configured to permit a user to set at least one of the current time, the current date and the current day of the week associated with the specific geographic region.

14. The method of claim 7, wherein the basic data set further comprises data for displaying the correct date and time adjustments for summer/winter time.

15. The method of claim 7, wherein the clock is part of a clock radio.

16. The method of claim 7, wherein, upon a power supply disconnect, the back-up power source ensures preservation of data stored in the memory and the operation of the microcontroller and time base generator.

17. The method of claim 16, wherein the back-up power source is a battery.

18. An electronic clock comprising:

a display;

a time base generator that generates a time base signal;

memory;

a microcontroller which generates a varying time signal based on data stored in said memory and the time base signal, the time base signal being capable of being directed to said display;

a battery providing power to ensure the function of said time base generator and said microcontroller during transport of the clock; and an electromechanical interface connected directly to the microcontroller through which varying time value data, associated with a particular time zone, may be electronically uploaded from a computer setting means into said memory to set the time generated by said microcontroller, whereby said varying time signal is maintained as long as said battery is providing power to said time base generator and said microcontroller.

19. The electronic clock of claim 18 further including a power supply, said power supply being capable of providing power to said microcontroller, said time base generator, and said memory; said battery backing up said power supply with respect to at least said microcontroller and said time base generator; and wherein, upon activating said power supply, said power supply is capable of providing power to said display so that viewing of the time generated by the microcontroller is at least enhanced.

20. The electronic clock of claim 18 further including a power supply, said power supply providing power to said microcontroller and said time base generator, said battery backing up said power supply with respect to at least said microcontroller and said time base generator; and, upon activation of said power supply and connection of its output to said display, the viewing of the time generated by the microprocessor is at least enhanced.

21. The electronic clock of any one of claims 18-20 wherein the battery further supplies power to said memory.

22. The electronic clock of claim 18 wherein said display is capable of additionally displaying at least one of the current date and current day of the week in the particular time zone, the memory is capable of additionally storing at least one of the current date and current day of the week in the particular time zone, and the interface is capable of uploading to the memory at least one of the current date and current day of the week in the particular time zone.

23. The electronic clock of claims 18 or 22 wherein said memory is capable of additionally storing time data for more than one time zone, and the interface is capable of uploading to the memory time data for more than one time zone that defines time in at least one time zone other than the particular time zone, and in response to receipt of user input, said display displays the time in the selected other time zone.

24. The electronic clock of claims 18 or 22 further including an entry device for causing the display to show the time in a time zone other than the particular time zone.

25. The electronic clock of claims 18 or 22 wherein said interface is capable of uploading to the memory data on summer time and winter time, and said microcontroller adjusts the displayed time based on said summer time and winter time data.

26. The electronic clock of claim 18 or 22 wherein said interface is capable of uploading to the memory data on leap years, and said microcontroller adjusts the displayed date based on said leap year data.

27. The electronic clock of claim 18 wherein said interface is located and arranged to be accessible after the manufacture of the clock is completed.

28. The electronic clock of claim 18 further including time input element controls, said time input controls being effective to permit the manual change of at least one of the time signal generated by the microcontroller, the current date and the current day of the week in said memory.

29. The electronic clock of claim 19 further including a radio powered by the power supply.

30. The electronic clock of claim 29 wherein the power supply is an AC power supply connected to a power grid and said time base generator is a high precision, crystal-controlled time base generator which may synchronize to the frequency of the power grid.

31. A method of presetting an electronic clock having a time base generator that generates a time base signal, a memory, a microcontroller, a battery for providing power to at least said time base generator and said microcontroller, and a power supply for providing power to at least the display, comprising the steps of:

connecting the battery to at least said time base generator and microcontroller to ensure their function during transport of the clock;

after manufacture of the clock and connection of the battery, electronically loading into the memory from a computer setting means via an electromechanical interface connected directly to the microcontroller, varying time value data valid in a particular time zone;

causing the microcontroller to use the time value data in the memory and the time base signal from the time base generator to generate a variable time signal valid for the time in the particular time zone; and upon supplying power from the power supply to the display, causing the display to show the time in the particular time zone without having to specifically manually set the clock.

32. The method of claim 31 wherein, during the step of loading, the current date and the current day of the week in the particular time zone are also loaded into memory; and after the step of supplying power from the power supply to the display, the display shows the current date and current day of the week in the particular time zone.

33. The method of claim 31 wherein, during the step of loading, varying time value data valid in at least one other time zone different from the particular time zone is also loaded into memory; and after the step of supplying power from the power supply to the display, and in response to receipt of a user input, said display shows the time in the other time zone.

34. The method of claim 31 wherein, in response to an entry signal from an entry device, the microcontroller alters the time signal to that of a time zone other than the particular time zone; and after the step of supplying power from the power supply to the display, said display shows the time in the other time zone.

35. The method of claim 31 wherein, during the step of loading, winter time and summer time data is also loaded into memory; and after the step of supplying power from the power supply to the display, the display shows time based on the winter time and summer time data.

36. The method of claim 32 wherein, during the step of loading, leap year data is also loaded into memory; and after the step of supplying power from the power supply to the display, the display shows the date adjusted for said leap year data.

37. The method of claim 31 wherein the step of electronically loading involves the steps of:

keeping track of time in a stipulated time zone as a varying digital code;

providing the code at the end of the interface;

connecting the interface to the clock such that the code is available at an input of said memory of the clock; and causing the memory to accept and store the current digital code at the end of the interface.

38. The method of claim 37 wherein a computer is used to keep track of time, provide the varying digital code and the signal which causes the memory to accept and store the current digital code.

39. An electronic clock having a microcontroller comprising:

a memory;

an electromechanical interface connected from a computer setting means directly to the microcontroller for uploading a basic data set comprising time of day data associated with a particular time zone into the memory;

a time base generator for generating a time increment signal;

a microcontroller for receiving the data set from memory and the time increment signal for generating a current time signal;

a power supply having a back-up battery adapted to ensure the function of the microcontroller and the time base generator during transport of the clock; and a display for indicating the current time, based on the current time signal received from the microcontroller, said display adapted to be powered by the power supply when the latter is connected.

40. The electronic clock of claim 39, wherein the clock is part of a clock radio.

41. The electronic clock of claim 39, further comprising:

entry elements cooperating with the microcontroller to cause a change in the current time.

42. The electronic clock of claim 39 wherein, upon activating said power supply, said power supply is capable of providing power to said display so that viewing of the time generated by the microcontroller is at least enhanced.

43. The electronic clock of claim 39 further including an entry device for causing the display to show the time in a time zone other than the particular time zone.

44. The electronic clock of claim 39 wherein said interface is located and arranged to be accessible after manufacture of the clock is completed.

* * * * *